US006568601B2

(12) United States Patent
Maynard

(10) Patent No.: US 6,568,601 B2
(45) Date of Patent: May 27, 2003

(54) BOLTLESS ADJUSTABLE RAIL BRACE ASSEMBLY WITH INTERNAL VERTICAL RESTRAINT

(75) Inventor: Rick I. Maynard, Chagrin Falls, OH (US)

(73) Assignee: Cleveland Track Material, Inc., Cleveland, OH (US)

( * ) Notice: Subject to any disclaimer, the term of this patent is extended or adjusted under 35 U.S.C. 154(b) by 0 days.

(21) Appl. No.: 09/942,371

(22) Filed: Aug. 29, 2001

(65) Prior Publication Data

US 2003/0042323 A1 Mar. 6, 2003

(51) Int. Cl.[7] ..... E01B 9/60
(52) U.S. Cl. ..... 238/292; 238/336
(58) Field of Search ..... 238/310, 22, 23, 238/292, 293, 336, 347

(56) References Cited

U.S. PATENT DOCUMENTS

| | | | | |
|---|---|---|---|---|
| 2,426,137 A | * | 8/1947 | Asselin | 238/292 |
| 3,358,927 A | | 12/1967 | Hein et al. | |
| 4,566,630 A | | 1/1986 | Keiper, Jr. | |
| 4,770,342 A | | 9/1988 | Farrell et al. | |
| 4,824,015 A | | 4/1989 | Farrell et al. | |
| 5,094,387 A | | 3/1992 | Rice et al. | |
| 5,104,041 A | | 4/1992 | Remington | |
| 5,651,499 A | | 7/1997 | Mihailoff et al. | |

* cited by examiner

*Primary Examiner*—S. Joseph Morano
*Assistant Examiner*—Lars A. Olson
(74) *Attorney, Agent, or Firm*—Rankin, Hill, Porter & Clark LLP

(57) ABSTRACT

A rail brace assembly provides positive support for a stock rail mounted on a switch brace plate. The assembly includes a rail brace that it is installed over a fixed block attached to the brace plate. The block has a slot and a channel that accept a mating rib and tapered wings connected to the underside of the rail brace. The interaction of these elements provides vertical restraint for the rail brace. The brace assembly includes a stop that is secured to the brace plate and a tapered wedge that is disposed between the stop and the rail brace. Upon driving the wedge longitudinally of the rail, lateral force is applied to the rail brace and the rail. The stop and the wedge employ a longitudinally extending tongue and groove to prevent relative vertical movement therebetween. The junction between the wedge and the rail brace is defined by mating convex-concave surfaces. A shear member such as a cotter pin prevents the wedge from being retracted once the wedge has been driven to a desired longitudinal position. Because the wedge cannot be moved inadvertently, lateral force will be applied continuously to the rail brace by the wedge.

17 Claims, 4 Drawing Sheets

BOLTLESS ADJUSTABLE RAIL BRACE ASSEMBLY WITH INTERNAL VERTICAL RESTRAINT

BACKGROUND OF THE INVENTION

Rail braces and rail brace assemblies are common railroad trackwork components, their primary function is to prevent rail rollover. They are most commonly used on railroad switches where the stock rail is not spiked, clipped or otherwise restrained on the gage (inside) side base. It is customary then that stock rails be braced on the field side to prevent rail rollover since the lateral forces generated by the passing locomotive and railcar wheels are sufficient to easily cause the rail to roll outwardly from track center. This rolling ultimately would allow the wheel to drop from the rail head causing the train to derail. Rail braces also are used in various locations where lateral forces are present, such as heavy curves on grades and in mountainous areas.

The evolution of rail braces began with one-piece rigid rail braces which were simply spiked into position up against the stock rail. These one-piece braces usually were forged from steel plate and were not adjustable. They commonly became loose after the passage of the first few trains.

Adjustable rail brace assemblies became preferred as they provided a means of retightening over time. Various types of adjustable rail brace assemblies used bolts to provide the tightening action. A good example of an adjustable, bolted rail brace assembly is the TOPNOTCHER adjustable rail brace developed by Pettibone Mulliken Corporation and still commercially available from Cleveland Track Material, Inc. of Cleveland, Ohio. These bolted designs provided adequate performance, a means of securing the brace in position and the ability to retighten. However, they were made of several components, were relatively expensive, and were time-consuming to install. Most importantly, they required maintenance in terms of retightening the nuts which always came loose due to vibration under load.

As train frequencies, tonnages and train speeds increased dramatically, and as track time required for installation and maintenance of the track components became much more restricted, the need for an improved rail brace assembly became apparent and necessary. In the 1980's there was a general trend within the railroad industry to minimize the use of threaded fasteners due to limited track time and reduced track maintenance crews.

In response to these considerations, several different boltless adjustable rail brace assemblies have been developed and marketed. Most of these boltless rail brace assemblies use a resilient rail clip fastener to secure the components into position. The most popular assemblies provide improved performance for many applications but have inherent drawbacks which limit their performance and which limit the types of locations and installations with which they can be used. These assemblies do not provide any positive vertical restraint (other than the toe load of the elastic fastener) to keep them secured tightly to the switch brace plate when subjected to any upward vertical force. Also, these assemblies cannot be adjusted easily to apply a desired lateral force to the stock rail. Yet additionally, installation of these assemblies is more difficult than desired.

With the advent of pre-assembled switch panels, concrete ties and automated track tamping, the limitations of the existing boitless rail brace designs are significant. The lifting action during loading and unloading of pre-assembled switch panels and the lifting action imparted during automated tamping, combined with the added weight of concrete ties, causes the brace assemblies to come loose and to be disengaged from the switch brace plates. This creates serious safety problems and new maintenance issues.

Despite the advances of recent boltless adjustable rail brace assemblies, there remains a need for a boltless adjustable rail brace assembly that provides positive vertical restraint. Preferably, any such rail brace assembly would be easy to manufacture, easy to assemble and disassemble, easy to apply any desired lateral force to the stock rail, and strong and reliable in operation.

SUMMARY OF THE INVENTION

In response to the foregoing concerns, the rail brace assembly of the present invention is adapted for use with a switch brace plate that supports a stock rail that extends along a longitudinal axis. The assembly according to the invention comprises a rail brace disposed adjacent the rail, the rail brace lying atop the brace plate, the rail brace having one or more rail-contacting walls, a wedge-contacting wall disposed opposite the rail-contacting walls, an upper wall, and a laterally extending rib with attached horizontally extending wings that extends downwardly from the underside of the upper wall. The assembly includes a stop connected to the brace plate, the stop being spaced laterally from the rail. The brace plate is disposed between the stop and the rail. The stop has a wedge-contacting wall. A wedge is disposed between the stop and the rail brace, the wedge having a stop-contacting wall and a rail brace-contacting wall. When the wedge is moved longitudinally of the rail, it causes the rail brace to be moved apart from the stop and against the rail.

A block is connected to the brace plate at a location between the rail and the wedge, and underneath the upper wall. The block has a laterally extending slot with a horizontally extending channel connected thereto. The slot and the channel are of a size and shape to receive the rib and wings, respectively, to thereby provide vertical restraint for the rail brace.

As will be discussed in detail hereafter, the invention provides solutions to the problems associated with prior devices. The various features and advantages of the invention will be apparent to those skilled in the art from a review of the accompanying specification, claim, and drawings.

DESCRIPTION OF THE PREFERRED EMBODIMENT

Figure 1:
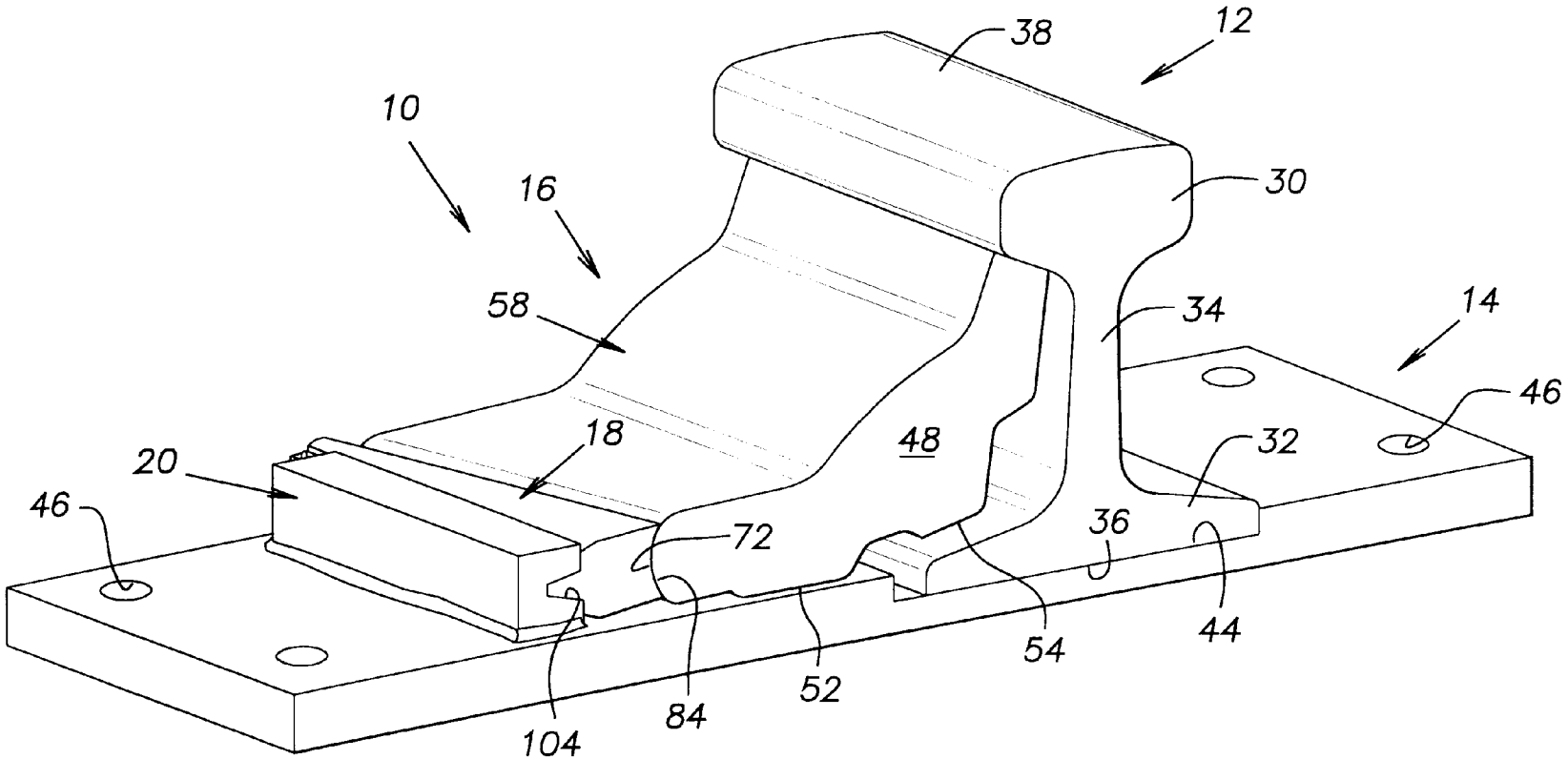
FIG. 1 is a perspective view of a rail brace assembly according to the invention showing the assembly as it is used in conjunction with a brace plate and a stock rail.
Figure 2:
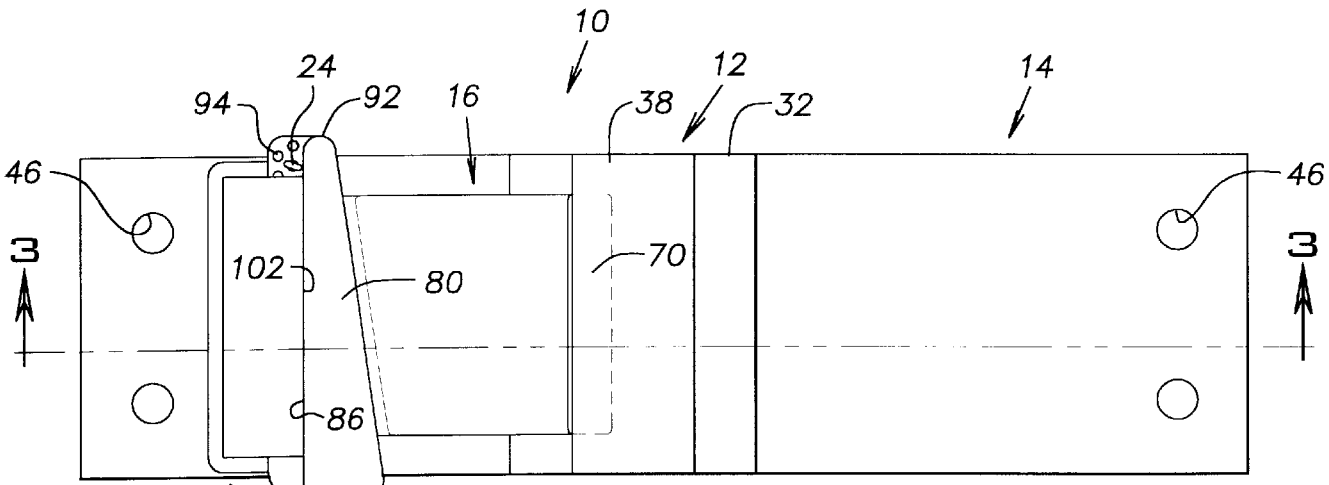
FIG. 2 is a top plan view of the invention of FIG. 1.

Referring to the FIGURES, a rail brace assembly according to the invention is indicated by the reference numeral 10.

The assembly 10 is intended to provide lateral or anti-rotational support for a stock rail 12 that is mounted to a brace plate 14. The assembly 10 includes a rail brace 16, a wedge 18, a stop 20, a block 22, and a shear member 24.

The stock rail 12 has three main components: a head 30, a base 32, and a web 34 that connects the head 30 and base 32. The base 32 has a flat bottom surface 36 that supports the rail 12 on the brace plate 14. The head 30 has a crowned upper surface 38 that provides the running contact surface for the wheel treads of the wheels of locomotives and railcars. The rail 12 also has a contact surface 40 on the underside of the head 30 and a contact surface 42 on the upper part of the base 32. The contact surfaces 40, 42 typically are used for fitting various track components such as castings, fillers, and joint bars. For purposes of the present invention, the rail 12 will be considered to have a longitudinal axis that extends along the length of the rail 12.

The brace plate 14 is an elongate, rectangular member having a seat 44 formed therein. The base 34 is fitted into the seat 44. The plate 14 also includes a plurality of openings 46 that enable the plate 14 to be mounted to various types of railroad ties (not shown).

Figure 3:
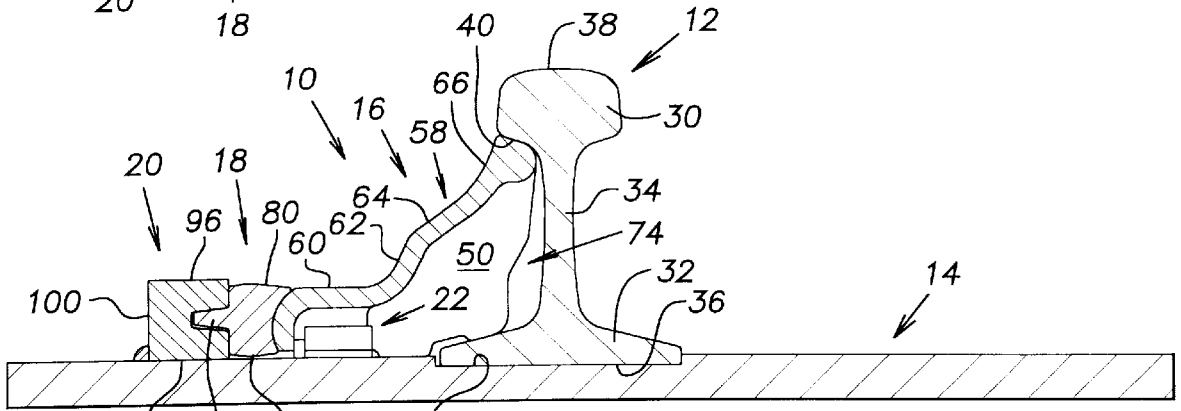
FIG. 3 is a cross-section view of a rail brace used with the invention.

The rail brace 16 includes first and second generally parallel sidewalls 48, 50. Each sidewall 48, 50 has a first segment 52 that contacts the upper surface of the base plate 14, a second segment 54 that contacts the contact surface 42, and a third segment 56 that contacts the contact surface 40. The rail brace 16 has an upper wall 58 that includes a first, generally horizontal segment 60, and first, second, and third segments 62, 64, 66 that are inclined from the vertical. The intersection between adjacent segments 60, 62, 64, 66 is made with a smooth radius. An inclined wall 70 is formed at the upper portion of the upper wall 58 and the side walls 48, 50. The rail brace 16 also has a smooth, tapered, wedge-contacting wall 72. Referring particularly to FIGS. 1 and 3, the sidewalls 48, 50 define an opening or relief area 74 where the web 34 meets the base 32. The opening 74 provides clearance for the installation of rail-mounted heater units that are commonly used in the industry. A laterally extending rib 76 extends downwardly from the underside of the horizontal segment 60. A pair of horizontally extending, generally V-shaped, tapered wings 78 are connected to the bottom of the rib 76. The wings 78 have their apex 79 closest to the rail 12 and the larger end farthest from the rail 12.

The wedge 18 is an elongate member that has upper and lower surfaces 80, 82, a smooth, concave, rail brace-contacting surface 84, and a smooth, flat, stop-contacting surface 86. A longitudinally extending tongue 88 projects from the stop-contacting surface 86. The wedge 18 is tapered longitudinally of its length such that is has a large end 90 and a small end 92. The taper is at a pre-determined angle of about 8.0 degrees relative to the longitudinal axis of the rail 12. In use, the stop-contacting surface 86 is parallel with the longitudinal axis of the rail 12, while the brace-contacting surface 84 is tapered along its length. A plurality of openings 94 are formed in the tongue 88 adjacent the small end 92.

The stop 20 has flat upper and lower surfaces 96, 98, a flat rear surface 100, and a smooth, flat, wedge-contacting surface 102. The surface 102 extends parallel with the longitudinal axis of the rail 12. A longitudinally extending groove 104 extends the length of the surface 102. The groove 104 is of the same size and shape as the tongue 88. When the wedge 18 and the stop 20 are assembled, the surfaces 86, 102 are in substantial surface-to-surface contact and the tongue 88 is securely fitted within the groove 104. The stop 20 is welded to the brace plate 14.

Figure 5:
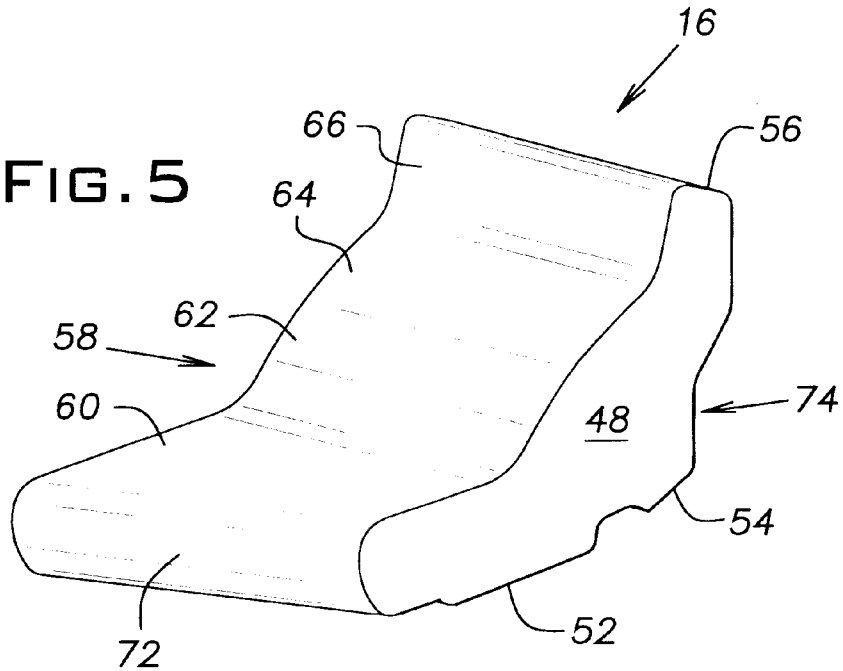
FIG. 5 is a perspective view of the rail brace of FIG. 4.
Figure 4:
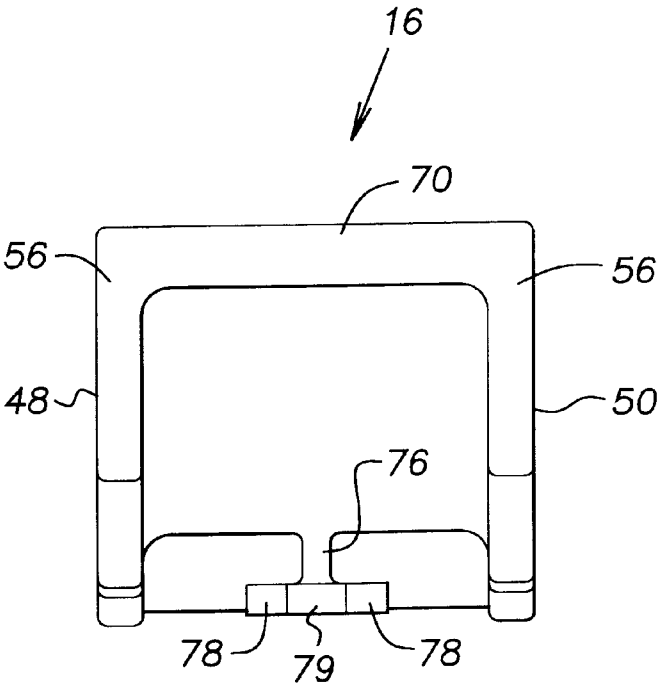
FIG. 4 a is front view of the rail brace included as part of the invention.
Figure 7:
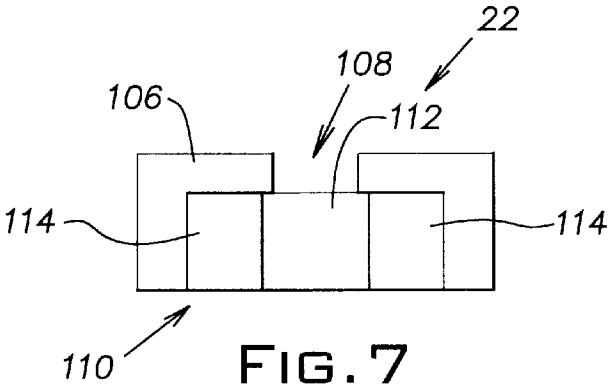
FIG. 7 is a view of the block looking to the right in FIG. 6.
Figure 8:
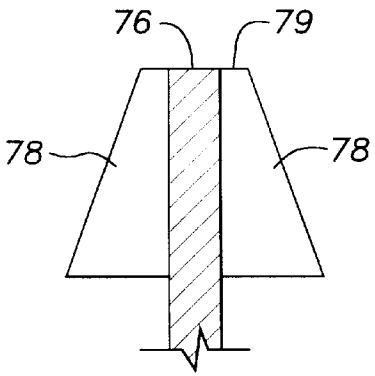
FIG. 8 is a cross-section view of a portion of the rail brace taken along a plane indicated by line 8—8 in FIG. 4.
Figure 6:
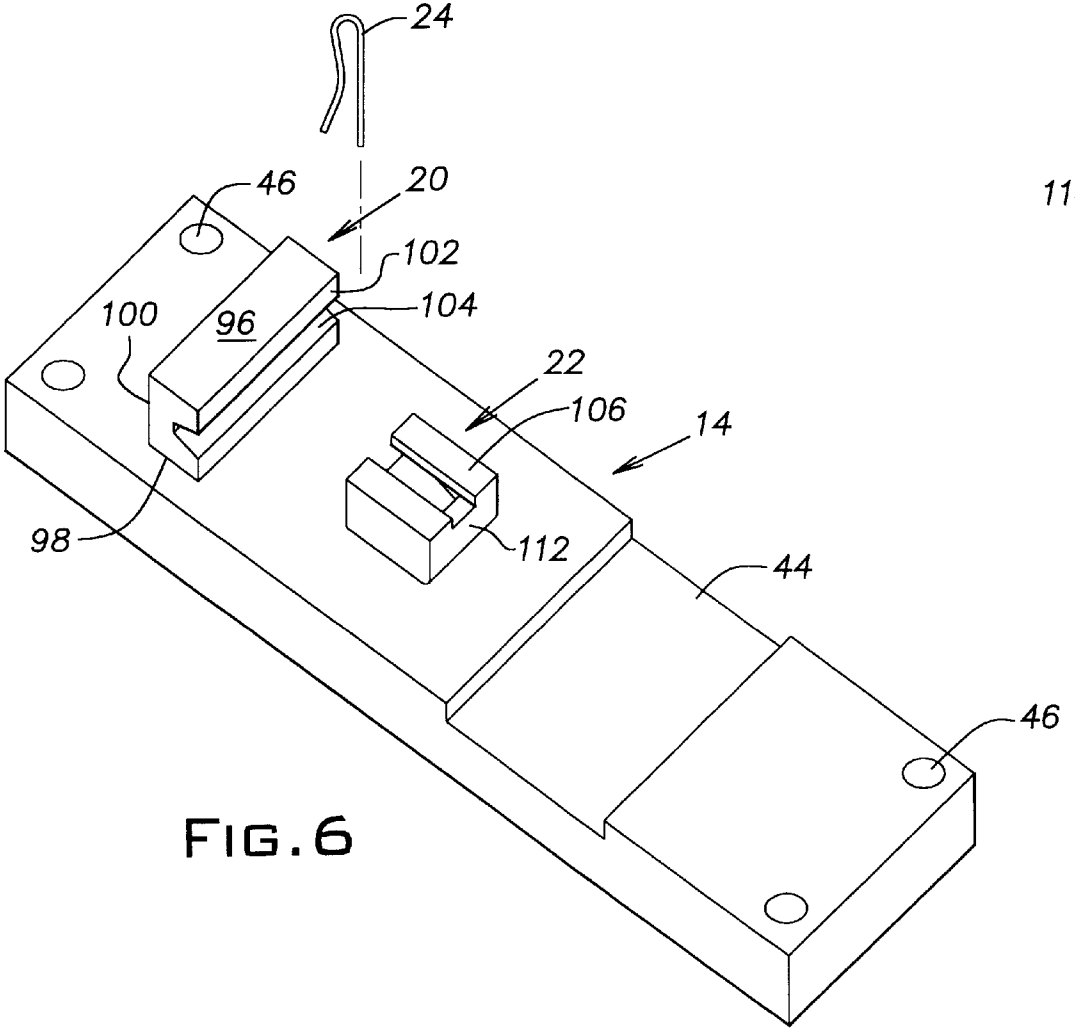
FIG. 6 is a perspective view of a brace plate with a stop and a block attached thereto.

Referring particularly to FIGS. 3 and 5, the block 22 is secured to the brace plate 14 as by welding. The block 22 has an upper wall 106 through which a laterally extending slot 108 extends. A horizontally extending channel 110 is formed within the block 22 and the slot 108 opens into the channel 110. The end of the channel 110 closest to the rail 12 is closed by an end wall 112. The sides of the channel 110 are defined by side walls 114 that taper from a larger dimension farthest from the rail 12 to a smaller dimension closer to the rail 12. The slot 108 and the channel 110 are of the same size and shape as the rib 76 and the wings 78, respectively. The dimensions of the rib 76, the wings 78, the slot 108, and the channel 110 are such that they provide an interference fit, or at least a near-interference fit, when the rail brace 16 is installed on the brace plate 14.

The shear member 24 is of a size and shape to fit into one of the openings 94. Preferably the shear member 24 is a cotter pin, although other elongate members such as a hitch pin, bolt or nail could be used, if desired.

OPERATION

In use, the rail brace 16 is positioned onto the brace plate 14 such that the segment 52 contacts the plate 14 and the segments 54, 56 contact the contact surfaces 40, 42, respectively. Also, the inclined wall 70 contacts the contact surface 40 and the rib 76 and the wings 78 are fitted within the slot 108 and the channel 110, respectively.

The small end 92 of the wedge 18 is positioned to be driven into the open space between the stop 20 and the convex wedge-contacting wall 72. As the wedge 18 is driven into position by a suitable tool such as a sledge hammer, surface contact is created between the concave surface 84 of the wedge 18 and the convex wall 72 of the rail brace 16. In addition, surface contact is created between the two flat surfaces 86, 102 and the tongue 88 and the groove 104. After the wedge 18 has been driven longitudinally as far as desired, the position of the wedge 18 can be maintained by inserting the shear member 24 into the opening 94 closest to the end of the stop 20.

The wedging action created by all of the mating surfaces described above drives the rail brace 16 tightly up against the stock rail 12. Contact surfaces 52, 54, 56 and the inclined wall 70 of the brace 16 are tightly wedged against the corresponding surfaces of the rail 12 to provide positive lateral force to the rail 12. As shown in FIGS. 1 and 3, the flange of the rail base 32 opposite to the rail brace 16 is driven tightly against the side surface of the rail seat 44. The interaction of the wings 78 and the channel 110 provides resistance to vertical movement of the rail brace 16.

As will be apparent from an examination of the FIGURES and the foregoing description, the vertically downward force applied by the rib 76, the wings 78, and the block 22 will resist vertical displacement of the rail brace 16 when the rail 12 is attempted to be moved laterally or rotationally under load from a passing wheel. The wedge 18 and the stop 20 provide excellent resistance to lateral forces delivered by the rail 12 through the rail brace 16. Because all mating surfaces of the rail brace 16, the wedge 18, and the stop 20 are smooth-sided, movement of the wedge 18 relative to the rail brace 16 and the stop 20 can occur easily during assembly. In turn, the amount of lateral force applied to the rail 12 can be controlled readily. The insertion of the shear member 24 into a selected one of the openings 94 enables the device to be assembled or disassembled without any special tools or equipment.

Although the invention has been disclosed in its preferred embodiment, it will be apparent to those skilled in the art that various changes and modifications can be made thereto without departing from the true spirit and scope of the invention as hereinafter claimed. Merely by way of example and not by way of limitation, it is possible to interchange the convex and concave surfaces 72, 84 or to interchange the tongue 88 and the groove 104. If the tongue 88 and the groove 104 are interchanged, the tongue 88 should extend beyond the large end 90 and the openings 94 should be located at the large end 90. It is intended that the patent shall cover, by suitable expression in the appended claims, all such changes and modifications.

What is claimed is:

1. A rail brace assembly adapted for use with a switch brace plate having a seat for receiving a stock rail, the stock rail extending along a longitudinal axis, the assembly comprising:

a rail brace disposed adjacent the rail, the rail brace lying atop the brace plate, the rail brace having:

one or more rail-contacting walls;

a wedge-contacting wall disposed opposite the rail-contacting walls;

an upper wall; and a laterally extending rib projecting downwardly from the underside of the upper wall, the rib having laterally extending wings projecting from its lower end;

a stop connected to the brace plate, the stop being spaced laterally from the rail, the brace plate being disposed between the stop and the rail, the stop having a wedge-contacting wall;

a wedge disposed between the stop and the rail brace, the wedge having a stop-contacting wall and a rail brace-contacting wall, the wedge, when moved longitudinally of the rail, causing the rail brace and the stop to be moved away from or toward each other; and a block connected to the brace plate, the block having:

an upper wall disposed beneath the upper wall of the rail brace;

a laterally extending slot that opens through the upper wall, the slot being of a size and shape to receive the rib; and a horizontally extending channel into which the slot opens, the channel being of a size and shape to receive the wings.

2. The rail brace assembly of claim 1, wherein the rail brace includes:

first and second side walls, the side walls being generally parallel with each other, each side wall having a first segment in contact with the brace plate, a second segment in contact with a lower portion of the rail, and a third segment in contact with an upper portion of the rail;

the upper wall extending between the first and second side walls;

an inclined wall in contact with the upper portion of the rail, the inclined wall extending between the side walls and forming an extension of the upper wall; and a wedge-contacting wall being disposed opposite the inclined wall, the wedge-contacting wall extending between the side walls and forming an extension of the upper wall.

3. The rail brace assembly of claim 1, wherein the upper wall includes:

a first inclined segment extending from the wedge-contacting wall;

a first generally vertical segment projecting upwardly from the first inclined segment;

a second inclined segment extending from the first generally vertical segment;

a second generally vertical segment projecting upwardly from the second inclined segment, and the intersections between each of the adjacent segments being smoothly contoured.

4. The rail brace assembly of claim 1, wherein a selected one of the wedge-contacting wall or the rail brace-contacting wall is convex and the other of the wedge-contacting wall or the rail brace-contacting wall is concave, the convex and concave portions being configured so that they are in substantial surface-to-surface contact with each other.

5. The rail brace assembly of claim 4, wherein the wedge-contacting wall is convex and the rail brace-contacting wall is concave.

6. The rail brace assembly of claim 1, wherein a longitudinally extending groove is formed in a selected one of the wedge-contacting wall or the stop-contacting wall and a longitudinally extending tongue projects from the other of the wedge-contacting wall or the stop-contacting wall, the tongue being of a size and shape to fit snugly within the groove while permitting the wedge-contacting wall and the stop-contacting wall to engage each other in substantial surface-to-surface contact.

7. The rail brace assembly of claim 6, wherein the groove is formed in the stop and the tongue projects from the wedge.

8. The rail brace assembly of claim 2, wherein:

the wedge-contacting wall of the stop is parallel with the longitudinal axis of the rail;

the stop-contacting wall of the wedge is parallel with the longitudinal axis of the rail;

the rail brace-contacting portion of the wedge is smoothly tapered at a pre-determined angle relative to the longitudinal axis of the rail so that the wedge has a larger end and a smaller end; and the wedge-contacting portion of the rail brace is smoothly tapered at the pre-determined angle relative to the longitudinal axis of the rail.

9. The rail brace assembly of claim 8, wherein the pre-determined angle is about 8.0 degrees.

10. The rail brace assembly of claim 6, further comprising:

a plurality of longitudinally spaced openings in the tongue, the openings being located toward the smaller end of the wedge; and a shear member adapted to be disposed in a selected one of the openings when the wedge is tightly compressed between the stop and the rail brace, the shear member preventing the wedge from being moved relative to the stop.

11. The rail brace assembly of claim 10, wherein the shear member is a cotter pin.

12. The rail brace assembly of claim 1, wherein the wings, when viewed from above, define a V-shape with the apex disposed closest to the rail.

13. A rail brace assembly adapted for use with a switch brace plate having a seat for receiving a stock rail, the stock rail extending along a longitudinal axis, the assembly comprising:

a rail brace disposed adjacent the rail, the rail brace lying atop the brace plate, the rail brace having:

first and second side walls, the side walls being generally parallel with each other, each side wall having a first segment in contact with the brace plate, a second segment in contact with a lower portion of the rail, and a third segment in contact with an upper portion of the rail;

an upper wall extending between the first and second side walls, the upper wall including:

a first inclined segment extending from the wedge-contacting wall;

a first generally vertical segment projecting upwardly from the first inclined segment;

a second inclined segment extending from the first generally vertical segment;

a second generally vertical segment projecting upwardly from the second inclined segment, and the intersections between each of the adjacent segments being smoothly contoured;

an inclined wall in contact with the upper portion of the rail, the inclined wall extending between the side walls and forming an extension of the upper wall; and a wedge-contacting wall opposite the inclined wall, the wedge-contacting wall extending between the side walls and forming an extension of the upper wall;

a laterally extending rib projecting downwardly from the underside of the upper wall, the rib having horizontally extending wings projecting from its lower end;

a stop connected to the brace plate, the stop being spaced laterally from the rail, the brace plate being disposed between the stop and the rail;

a wedge disposed between the stop and the rail brace, the wedge, when being moved longitudinally of the rail, causing the rail brace and the stop to be moved away from or toward each other, the wedge having a rail brace-contacting portion, the stop includes a wedge-contacting wall that faces the wedge and a longitudinally extending groove is formed in a selected one of the wedge-contacting wall or the stop-contacting wall;

a longitudinally extending tongue projects from the other of the wedge-contacting wall or the stop-contacting wall, the tongue being of a size and shape to fit snugly within the groove while permitting the wedge-contacting wall and the stop-contacting wall to engage each other in substantial surface-to-surface contact;

a selected one of the wedge-contacting wall of the rail brace or the rail brace-contacting portion of the wedge being convex and the other of the wedge-contacting wall of the rail brace or the rail brace-contacting portion of the wedge being concave, the convex and concave portions being configured so that they are in substantial surface-to-surface contact with each other;

the wedge-contacting wall of the stop is parallel with the longitudinal axis of the rail;

the stop-contacting wall of the wedge is parallel with the longitudinal axis of the rail;

the rail brace-contacting portion of the wedge is smoothly tapered at a pre-determined angle relative to the longitudinal axis of the rail so that the wedge has a larger end and a smaller end;

the wedge-contacting portion of the rail brace is smoothly tapered at the pre-determined angle relative to the longitudinal axis of the rail;

a plurality of longitudinally spaced openings in the tongue, the openings being located toward the smaller end of the wedge if the tongue projects from the wedge and at the larger end of the wedge if the tongue projects from the stop;

a shear member adapted to be disposed in a selected one of the openings when the wedge is tightly compressed between the stop and the rail brace, the shear member preventing the wedge from being moved relative to the stop; and a block connected to the brace plate, the block having:

an upper wall disposed beneath the upper wall of the rail brace;

a laterally extending slot that opens through the upper wall, the slot being of a size and shape to receive the rib; and a horizontally extending channel into which the slot opens, the channel being of a size and shape to receive the wings.

14. The rail brace assembly of claim 13, wherein the groove is formed in the stop and the tongue projects from the wedge.

15. The rail brace assembly of claim 13, wherein the wedge-contacting portion of the rail brace is convex and the rail brace-contacting portion of the wedge is concave.

16. The rail brace assembly of claim 13, wherein the pre-determined angle is about 8.0 degrees.

17. The rail brace assembly of claim 13, wherein the shear member is a cotter pin.

* * * * *